United States Patent [19]

Dettmer

[11] 4,027,858

[45] June 7, 1977

[54] APPARATUS FOR MIXING

[75] Inventor: Edward V. Dettmer, Bay City, Mich.

[73] Assignee: The Dow Chemical Company, Midland, Mich.

[22] Filed: June 29, 1976

[21] Appl. No.: 700,938

[52] U.S. Cl. ..... 259/4 R; 222/145; 222/494; 425/DIG. 49

[51] Int. Cl.[2] ..... B01F 15/02; B01F 5/04

[58] Field of Search ..... 259/4 R, 4 AC, 4 AB, 259/191, 192, 193, 18, 36; 425/463, DIG. 49, 200, 206; 222/145, 494

[56] References Cited

UNITED STATES PATENTS

| | | | |
|---|---|---|---|
| 2,758,553 | 8/1956 | Moser | 222/145 |
| 2,815,532 | 12/1957 | Braunlich | 425/463 |
| 3,230,972 | 1/1966 | Davis | 425/DIG. 49 |
| 3,792,839 | 2/1974 | Gidge | 259/193 |
| 3,801,073 | 4/1974 | Kates | 259/4 R |
| 3,936,382 | 2/1976 | White | 259/4 AB |

*Primary Examiner*—Robert W. Jenkins
*Attorney, Agent, or Firm*—R. B. Ingraham

[57] ABSTRACT

Liquids, particularly viscous and nonviscous liquids with at least limited mutual solubility, are admixed by introducing one of the liquids into a stream of the other in the form of thin tubes which usually form droplets and by maintaining the resultant two-component stream at a temperature such that the material of the thin tube diffuses throughout the stream to provide mixing of a desired degree.

3 Claims, 2 Drawing Figures

APPARATUS FOR MIXING

Figure 1:
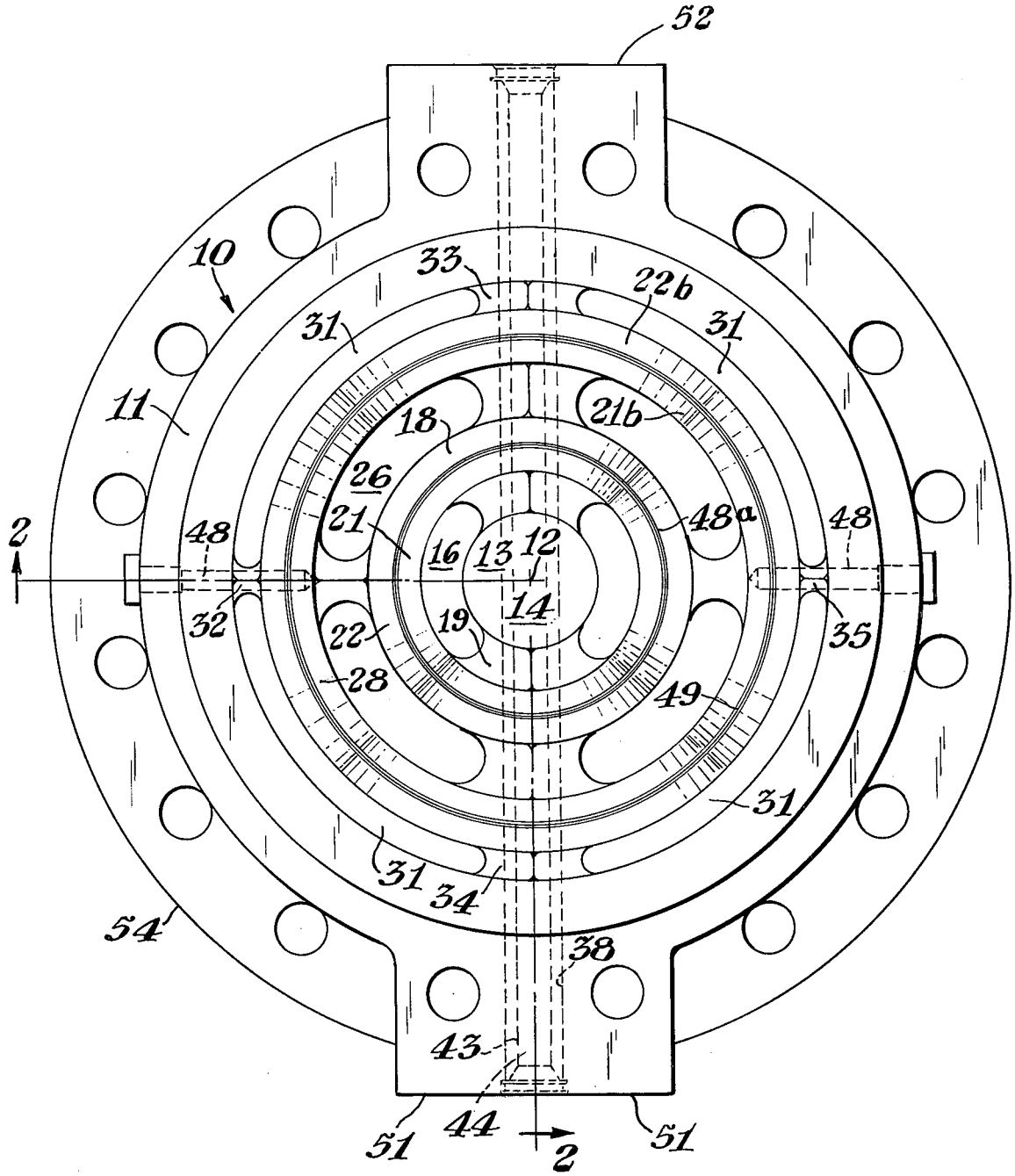

Mixing, particularly where viscous, relatively high viscosity materials are concerned, has been a problem for many years. Even in instances where the components are miscible in all proportions, high viscosity of one component has generally required either a long period of time, or alternately, mechanical mixing which usually requires a large power input. Many mixing machines have been devised and have been found more or less successful for the mixing of viscous materials. In general, such machines have required a substantial power input and also require periodic maintenance. In relatively recent years, alternate forms of mixers have been devised which provide mixing by flattening a stream, dividing the stream, recombining and repeating the operation until the stream consists of a number of very thin layers. Such mixers are often referred to as interfacial surface generators, static mixers, motionless mixers and the like. Such mixers are eminently suited for viscous liquids, particularly when mixing two viscous liquids. However, when two liquids of widely differing viscosity are employed, a significant tendency is noted for the material of the lower viscosity, particularly if present in a relatively small proportion, to form droplets or minor streams which are generally unaffected by passage of the composite stream through additional mixing stages, and if adequate dispersion of the low viscosity component and the high viscosity component is to be obtained, generally one must rely on mechanical shear or a diffusion of the material of the droplets into the higher viscosity component. Attempts have been made to provide uniform mixing by introducing one liquid to the other in the form of thin sheets wherein a first stream is divided into a number of parallel plate-like elements, thin sheets of a second liquid introduced between sheets of the first and the streams recombined. As the pressure differential increases between the two streams, the thin sheets become nonuniform, that is, they are thicker in the central portions than at their edges. Efforts have been made to introduce a plurality of streams into a main stream, for example, employing the apparatus disclosed in U.S. Pat. No. 2,815,532. As the pressure differential increases, the concentration of the additive can increase toward the central portion of the stream. Porous metal vanes have been disposed within the stream, for example, as in U.S. Pat. No. 3,792,839. Such a technique is eminently satisfactory in some instances, however, porous metal once plugged is oftentimes very difficult to restore to its original porosity. In some instances it is extremely desirable that one provide a means of introducing a liquid of low viscosity into a stream of high viscosity in a selective manner, that is, one has the option of adding or not adding the material of low viscosity wherein the high-viscosity material is the major portion of the stream. Additive devices frequently fail in such an application due to the backflow of the viscous component into the additive device.

It would be desirable if there were available an improved apparatus for the admixture of liquid components.

It would also be desirable if there were available an apparatus for the selective addition of a low-viscosity liquid to a high-viscosity liquid which did not rely on a high degree of mechanical shearing.

It would further be desirable if there were available an apparatus to aid admixture of liquids which was of simple construction without moving parts.

These benefits and other advantages in accordance with the present invention are achieved in a fluid dispenser or mixing aid having a dispenser body, the dispenser body having a first end, a second end and a longitudinal axis, the dispenser body defining a generally centrally disposed mandrel, the mandrel having a first end and a second end, the first and second ends of the mandrel being disposed generally along the longitudinal axis, the body defining at least one generally concentric first passageway generally surrounding the mandrel, the body defining a first generally annular dispensing means disposed about said first passageway and affixed to mandrel, the first dispensing means having defined therein a fluid passage means and an annular dispensing portion, the fluid passage means being in operative connection with the first dispensing means, the dispensing portion having first and second concentric annular lip means, the first and second lip means being generally concentric about the mandrel, the lip means converging at a location remote from the supply passage and in the direction of the first body end, the lip means being deflectable by fluid pressure internal and external thereto, the lip means and the body defining an enclosed generally annular plenum, the body defining a support means external to the dispensing means and a second plurality of passageways radially outwardly disposed from the first dispensing means, the second plurality of passageways extending generally parallel to the first plurality of passageways, the body defining a support means external to the second plurality of passageways, the support means being adapted to be operatively connected to a conduit, the body defining generally radially outwardly extending minor stream supply passages in communication with said fluid passage means.

Figure 2:
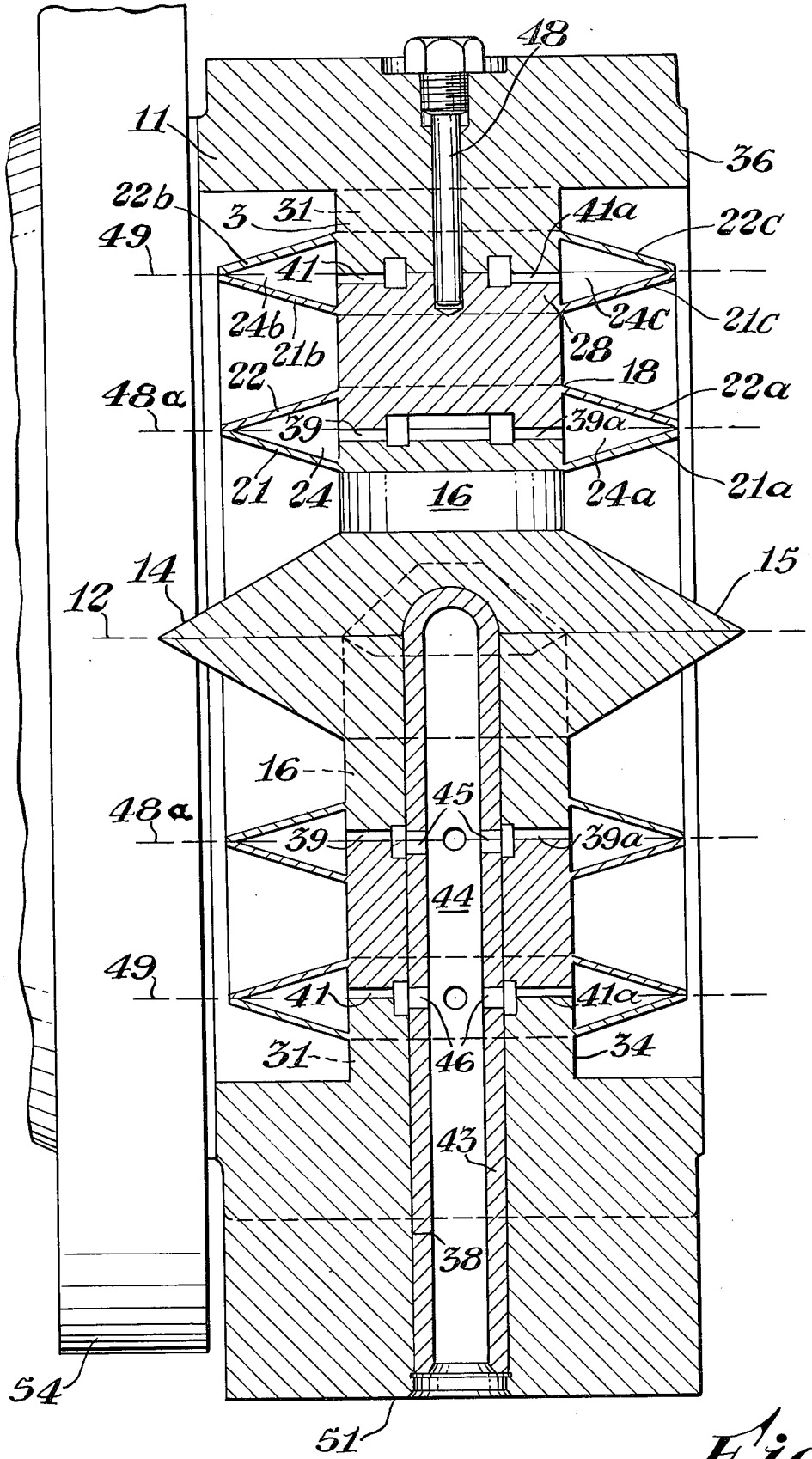

Further features and advantages of the present invention will become more apparent from the following specification taken in conjunction with the Drawing wherein:

FIG. 1 is a face or end view of a mixing aid in accordance with the present invention; and FIG. 2 is a sectional view of the mixing aid of FIG. 1.

In FIGS. 1 and 2 there is depicted a face view and sectional view of a mixing aid in accordance with the present invention generally designated by the reference numeral 10. The mixing aid 10 comprises a body 11. The body 11 has a longitudinal axis 12 extending generally normally to the plane of the paper. The body 11 defines a generally centrally disposed mandrel 13. The mandrel 13 has a first end 14 and a second end 15. As depicted in FIGS. 1 and 2, the mandrel 13 has a generally circular cross-sectional configuration. A first plurality of passageways 16 are defined by the body 11. The passageways 16 extend entirely through the mixing aid 10 in a direction generally parallel to the axis 12. The body 11 defines a first dispensing means 18. The dispensing means 18 has a generally annular configuration, is concentric with the mandrel 14 and is disposed external to the first plurality of passageways 16. Between the first dispensing means 18 and the mandrel 14 are webs or spider arms 19 which serve to maintain the adjacent portion of the dispensing means 18 in fixed spaced relationship to the mandrel 14. The dispensing means 18 has affixed thereto a first dispensing lip portion 21 and a second opposed dispensing lip portion 22.

The lip portions 21 and 22 are of annular concentric configuration and converge at a location remote from the central portion of the cross-sectional configuration of the first dispensing means 18. The body 11 and the lips 21 and 22 define an annular plenum 24 of generally triangular cross-sectional configuration. The lips 21 and 22 extend in a direction generally parallel to the axis 12. The lips 21 and 22 are fluid-pressure deflectable. Oppositely disposed to and spaced from the lips 21 and 22 are a generally like coaxial pair of lips 21*a* and 22*a* having disposed therebetween a plenum 24*a*. A plurality of arcuate concentric slots 26 are defined by the body 11 external to the first dispensing means 18. A second dispensing means 28 is generally concentrically disposed about the first dispensing means 18 and is of similar construction and of larger diameter. The dispensing means 28 has dispensing lip members 21*b*, 22*b*, 21*c* and 21*d* which define annular plenums 24*b* and 24*c* respectively. The lip members 21, 22, 21*b* and 22*b* terminate in a plane generally normal to the axis 12 as do the lip members 21*a*, 22*a*, 21*c* and 22*c*. A third plurality of generally arcuate slots 31 are defined by the body 11 at a location remote from the mandrel 14 and adjacent the second dispensing means 28. The body 11 defines a plurality of webs 32, 33, 34 and 35 which are affixed to a conduit engaging means 36 which encircles the dispensing elements and passageways 31. The body 11 defines a generally diametrically disposed passage 38 extending entirely therethrough and passing through webs. The passage 38 is in communication with a first distribution passage 39 extending in a generally axial direction and providing communication between passageway 38 and the annular plenum 24. Similar passages 39*a* provide communication between passageways 38 and the plenum 24*a*. Generally similarly disposed passages 41 and 41*a* are defined by the body within the second distributing means 28 and provide communication with plenums 24*b* and 24*c*. Disposed within passageway 38 is a hollow dowel 43 having defined therein a passageway 44 and generally radially extending passageways 45 in communication with the passageways 39 and 39*a* and radially extending passageways 46 in communication with passageways 41 and 41*a*. Locating dowels 48 are generally diametrically opposed and extending and are disposed generally at right angles to the passageway 38. For purposes of construction, the mixing aid 10 is made in three separate pieces. The pieces are concentrically arranged and part along two cylindrical surfaces indicated by the reference numerals 48*a* and 49. At the periphery of the mixing aid 10 are disposed flange receiving faces 51 and 52 which permit connection of an external conduit to the passage 44 of the hollow dowel 43. Additive material may be fed from either or both ends of the dowel 43. There is depicted a pipe flange 54 in engagement with the conduit engaging means 36.

In operation the mixing aid may be clamped between a pair of such flanges. In operation of the mixing aid of the present invention, a major liquid stream is passed through the mixing aid 10 through the slots 16, 20 and 31. The additive material stream is passed to a passageway 44 of the hollow dowel 43. The additive material stream is then distributed by means of the passageways 39 and 39*a* to the plenums 24, 24*a* and the passages 41 and 41*a* to the plenums 24*b* and 24*c*, respectively. If the pressure within the plenums is less than the pressure of the major component flowing through the slots 16, 26 and 31, the lip members such as the lip members 21 and 22 are forced together and entry of liquid into the plenums from space exterior to the mixing aid is prevented. When the pressure of liquid within the plenum such as the plenum 24 exceeds the pressure of the liquid exterior to the mixing aid, the lips such as the lips 21 and 23 are elastically deformed to permit flow from the plenum into the surrounding liquid. The mixing aid 10 as depicted in FIGS. 1 and 2 provides to a stream flowing through the mixing aid two concentric uniform layers of additive material.

FIG. 2 depicts the lips 21, 22, 21*a* and 22*a* of the first dispensing means as being thinnner than the lips 21*b*, 22*b*, 21*c* and 22*c* of the second dispensing means 28, this configuration being necessary if the separation of the lips under a given pressure is equal. Although the drawing depicts a mixing aid having two dispensing means (18 and 28), mixing aids in accordance with the present invention are readily prepared having larger numbers of dispensing means.

The mixing element of FIGS. 1 and 2 is particularly desirable in that liquid-tight seals are required at the flange receiving faces 51 and 52 of which at least one is connected to a supply conduit and optionally the remaining face to a blind flange. No liquid-tight seal is required within the mixing aid as any leakage such as about the hollow dowel 43 can find its way only to the dispensing plenums 39, 39*a*, 41 and 41*a*.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A fluid dispenser or mixing aid having a dispenser body, the dispenser body having a first end, a second end, and a longitudinal axis, the dispenser body defining a generally centrally disposed mandrel, the mandrel having a first end and a second end, the first and second ends of the mandrel being disposed generally along the longitudinal axis, the body defining at least one generally concentric first passageway generally surrounding the mandrel, the body defining a first generally annular dispensing means disposed about said first passageway and affixed to the mandrel, the first dispensing means having defined therein a fluid passage means and an annular dispensing portion, the fluid passage means being in operative connection with the first dispensing means, the dispensing portion having first and second concentric annular lip means, the first and second lip means being generally concentric about the mandrel, the lip means converging at a location remote from the supply passage and in the direction of the first body end, the lip means being deflectable by fluid pressure internal and external thereto, the lip means and the body defining an enclosed generally annular plenum, the body defining a support means external to the dispensing means and a second plurality of passageways radially outwardly disposed from the first dispensing means, the second plurality of passageways extending generally parallel to the first plurality of passageways, the body defining a support external to the second plurality of passageways, the support means being adapted to be operatively connected to a conduit, the body defining generally radially outwardly extending minor stream supply passages in communication with said fluid passage means.

2. The dispenser of claim 1 including third and fourth concentric annular lip means disposed toward the second end of the mandrel on the first dispensing means, third and fourth lip means being generally similarly arranged as the first and second lip means.

3. The dispenser of claim 1 including a second dispensing means generally coaxially disposed with respect to the first dispensing means.

* * * * *